US006698681B1

(12) United States Patent
Guy et al.

(10) Patent No.: US 6,698,681 B1
(45) Date of Patent: Mar. 2, 2004

(54) APPARATUS AND METHOD FOR WINDING PAPER

(75) Inventors: Fredrick Addison Guy, Tulsa, OK (US); Samuel Jeb Chambliss, Appleton, WI (US); Joseph Kevin Beckett, Broken Arrow, OK (US); Bernie Michael Baldwin, Tulsa, OK (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/265,021

(22) Filed: Oct. 4, 2002

(51) Int. Cl.[7] ..... B65H 18/26

(52) U.S. Cl. ..... 242/534; 242/532.2; 242/535.4; 242/541.3

(58) Field of Search ..... 242/535.4, 532.2, 242/534, 541.3

(56) References Cited

U.S. PATENT DOCUMENTS

| | | | |
|---|---|---|---|
| 5,607,551 | A | 3/1997 | Farrington, Jr. et al. |
| 5,901,918 | A | 5/1999 | Klerelid et al. |
| 5,944,273 | A | 8/1999 | Lin et al. |
| 6,425,512 | B2 | 7/2002 | Hill et al. |

FOREIGN PATENT DOCUMENTS

| | | | |
|---|---|---|---|
| DE | 198 48 807 | A1 | 4/2000 |
| WO | WO 98/55384 | A1 | 12/1998 |

OTHER PUBLICATIONS

American Society for Testing Materials (ASTM) Designation: D 737–96, "Standard Test Method for Air Permeability of Textile Fabrics," pp. 207–211, published Apr. 1996.

*Primary Examiner*—Kathy Matecki
*Assistant Examiner*—Sang Kim
(74) *Attorney, Agent, or Firm*—Scott A. Baum

(57) ABSTRACT

An apparatus and method for winding tissue webs into a parent roll is disclosed which results in greater uniformity in the wound tissue roll and improved turn-up efficiency. The apparatus and method includes engaging the tissue web against a reel spool with an air permeable flexible member, such as a transfer belt, which traverses a winding region that includes an unsupported span between two support rolls. The web is transferred from the transfer belt to the parent roll as the parent roll is urged against the tissue web residing on the transfer belt at a point within the winding region. Located along at least a portion of the air permeable transfer belt within the winding region is a pressure reduction means adjacent the belt. The pressure reduction means serves to stabilize the tissue web on the belt improving sheet handling and turn-up efficiency. A sensor measures the deflection of the transfer belt during winding. In response, the reel spool position is changed to control the deflection at a desired level.

21 Claims, 3 Drawing Sheets

APPARATUS AND METHOD FOR WINDING PAPER

BACKGROUND

In the manufacture of various types of tissue products such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

In winding the tissue web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, wrinkles, etc., or, in other words, the roll should be "dimensionally correct." Likewise, the form of the parent roll must be stable, so that it does not depart from its cylindrical shape during storage or routine handling, or, in other words, the parent roll should be "dimensionally stable." Defects can force entire parent rolls to be scrapped if they are rendered unsuitable for high speed conversion.

New tissue reels and winders having an endless belt, such as that disclosed in U.S. Pat. No. 5,901,918 issued May 11, 1999 to Klerelid et al. and herein incorporated by reference, are found effective in the winding of tissue webs having a bulk of 9 cubic centimeters per gram or higher and a high level of softness, as characterized, for example, by an MD Max Slope of about 10 kilograms or less per 3 inches of sample width. Such reels and winding methods can be used to produce dimensionally correct and dimensionally stable parent rolls of such soft tissue webs having diameters on the order of 70 to 150 inches. Such parent rolls are disclosed and claimed in U.S. Pat. No. 5,944,273 issued Aug. 31, 1999 to Lin et al. and herein incorporated by reference.

However, as the winding speeds of such reels are increased to production rates exceeding 3,600 fpm, effectuating an efficient turn-up and maintaining sheet control of the tissue web on the endless belt can be challenging. Therefore there is a need for a method of winding soft, bulky tissue sheets in which the variability in sheet bulk, caliper, machine direction stretch, and/or basis weight is minimized, while still maintaining parent roll characteristics that are favorable to manufacturing and converting operations. There is also a need for such a reel to operate at machine speeds in excess of 3,600 fpm while maintaining sheet control and a high level of turn-up efficiency in order to manufacture such tissue webs cost effectively.

SUMMARY

These and other needs are met by the apparatus and method according to the present invention which includes an endless flexible member having a winding region for engaging the web of tissue paper against a reel spool and a web transport region. The endless flexible member thus forms a "soft nip" with the reel spool. A deflection sensor is mounted adjacent to the flexible member for measuring the amount of deflection of the flexible member. The amount of deflection is related to the pressure at the nip point and, by moving the reel spool and flexible member away from each other as the diameter of the paper roll increases, the pressure can be controlled at a desired level. Accordingly, the tissue winding parameters are greatly improved and the differences in properties of an unwound paper roll can be minimized.

To maintain sheet control and to improve turn-up efficiency, the endless flexible member is air permeable. A means for pressure reduction, such as a coanda vacuum box, is located along at least a portion of the endless flexible member in the winding region. A reduced air pressure is generated on an inside surface of the flexible member such that the tissue web disposed on an outside surface of the flexible member is brought into contact with the flexible member. Accordingly, during a turn-up improved efficiency results due to the control of the tissue web, particularly of the loose bits and scrap material present when the web tears as the turn-up progresses. In addition, during parent roll winding, less skating and weaving of the tissue web from the improved contact with the flexible member results in a parent roll having a more uniform cylindrical shape.

Hence in one aspect the invention resides in, an apparatus for winding a web into a roll including a rotatably mounted reel spool; an air permeable endless flexible member mounted for rotation along a predetermined path of travel having a winding region and a web transport region, and the winding region is positioned adjacent to the reel spool; a sensor measuring a deflection of the flexible member from the predetermined path of travel; an actuator for positioning the reel spool and the flexible member relative to each other to vary the deflection of the flexible member; a controller connected to the sensor and the actuator for controlling the deflection of the flexible member as the roll increases in diameter; and a means for pressure reduction located along at least a portion of the predetermined path of travel in the winding region.

In another aspect the invention resides in, an apparatus for winding a web of paper material into a roll including a rotatably mounted reel spool; a drive motor for rotating the reel spool and winding a paper web thereon to create a parent roll of increasing diameter; an air permeable endless flexible belt having an inside surface and an outside surface supported for rotation around a plurality of support rolls defining a predetermined path of travel, the predetermined path of travel having a winding region including a free span and a pair of support rolls, and a web transport region preceding the winding region, the paper web residing on the outside surface and positioned adjacent the reel spool engaging the reel spool during winding such that the free span is deflected from the predetermined path of travel by the paper web wound on the reel spool; a deflection sensor mounted within the belt measuring a deflection of the inside surface from the predetermined path of travel; an actuator for positioning the reel spool and the belt relative to each other to vary the deflection of the inside surface; a controller connected to the deflection sensor and the actuator for controlling the deflection of the inside surface as the parent roll diameter increases; and a means for pressure reduction located along at least a portion of the inside surface in the winding region.

In another aspect the invention resides in a method of winding a web to form a roll comprising the steps of: engaging an endless flexible member against a reel spool creating a nip such that the flexible member is deflected from a predetermined path of travel, the endless flexible member having a winding region, a web transport region, and an inside surface; rotating the reel spool; rotating the endless flexible member; advancing the web into the nip and directing the web around the reel spool to form a roll of increasing diameter; sensing the amount of deflection of the flexible member by the roll as the diameter of the roll increases; moving at least one of the reel spool and the flexible member in response to the sensing step to vary the amount of deflection of the flexible member; and reducing the pressure along at least a portion of the inside surface within the winding region.

BRIEF DESCRIPTION OF THE DRAWINGS

The above aspects and other features, aspects, and advantages of the present invention will become better understood with regard to the following description, appended claims, and accompanying drawings where:

DETAILED DESCRIPTION

Figure 1:
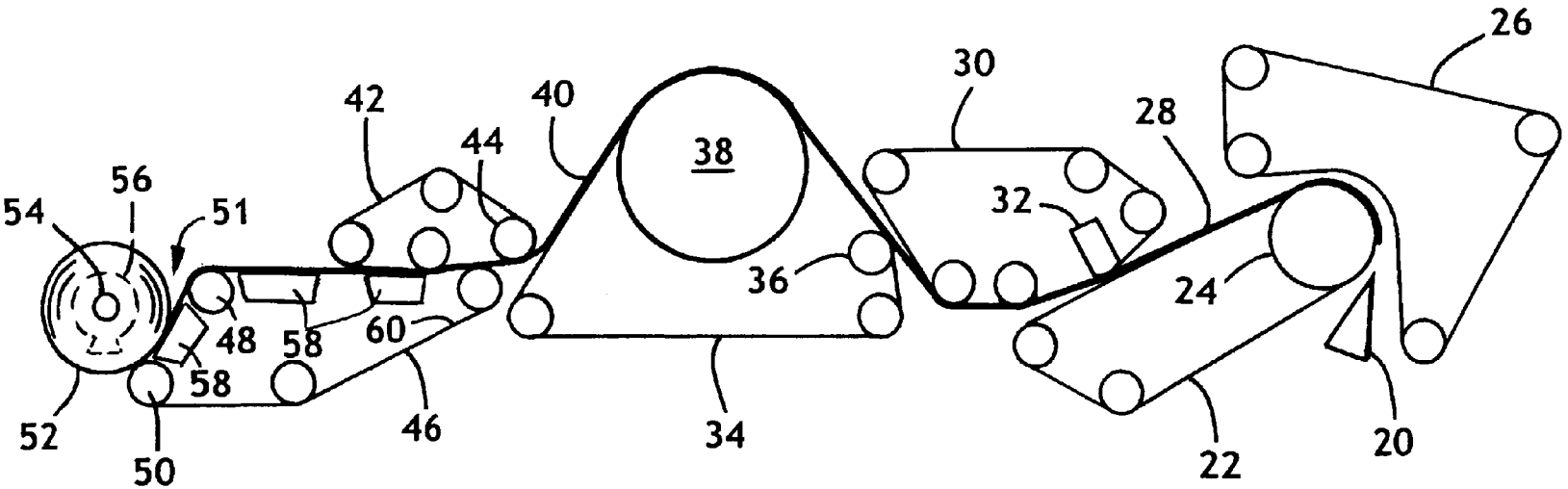
FIG. 1 illustrates a schematic process flow diagram of a method for making soft high bulk tissue sheets in accordance with this invention.

FIG. 1 illustrates a schematic flow diagram of a through-air drying process for making uncreped through-air dried tissue sheets. It should be understood, however, that the present invention could also be used with the creping process for tissue webs. Shown is a headbox 20 which deposits an aqueous suspension of papermaking fibers onto an inner forming fabric 22 as it traverses a forming roll 24. An outer forming fabric 26 serves to contain the web 28 while it passes over the forming roll and sheds some of the water. The wet web 28 is then transferred from the inner forming fabric to a wet end transfer fabric 30 with the aid of a vacuum transfer shoe 32. This transfer is preferably carried out with the transfer fabric traveling at a slower speed than the forming fabric (rush transfer) to impart stretch into the final tissue sheet. The wet web is then transferred to the through-air drying fabric 34 with the assistance of a vacuum transfer roll 36.

The through-air drying fabric 34 carries the web over a through-air dryer 38, which moves hot air through the web to dry it while preserving bulk. There can be more than one through-air dryer in series (not shown), depending on the speed and the dryer capacity. The dried tissue sheet 40 is then transferred to a first dry end transfer fabric 42 with the aid of vacuum transfer roll 44.

The tissue sheet, shortly after transfer, is sandwiched between the first dry end transfer fabric 42 and the transfer belt 46 to positively control the sheet path. The transfer belt is air permeable. Specifically, the transfer belt can have an air permeability greater than about 50 cubic feet per minute per square foot of fabric (cfm/ft$^2$). More specifically, the transfer belt can have an air permeability from about 100 to about 300 cfm/ft$^2$, and still more specifically from about 125 to about 175 cfm/ft$^2$. Air permeability, which is the air flow through a fabric while maintaining a differential air pressure of 0.5 inches of water across the fabric, is tested in accordance with ASTM test method D737-96 entitled "Test Method for Air Permeability of Textile Fabrics." A copy of the test method is available from ASTM International having an office at 100 Barr Harbor Drive, West Conshohocken, Pa. 19428-2959 USA. The air permeability of the transfer belt 46 is less than that of the first dry end transfer fabric 42, causing the sheet to naturally adhere to the transfer belt. At the point of separation, the sheet 40 can follow the transfer belt 46 due to vacuum action. In addition, the transfer belt 46 is preferably smoother than the first dry end transfer fabric 42 in order to enhance transfer of the sheet 40. To further effectuate a smooth transfer, a vacuum box, a coanda vacuum box, or other pressure reduction means can be located adjacent the transfer belt 46 to assist in transferring the sheet 40 to the transfer belt.

Suitable paper machine fabrics having the requisite air permeability for use as transfer belts include, without limitation: A 96W fabric, having an air permeability of 150 cfm/ft$^2$, or a 934 fabric available from AstenJohnston having an office at 6480 W. College Avenue, Appleton, Wis., USA. A Montex VP fabric, having an air permeability of 50 cfm/ft$^2$, a T807, or a T1208-3 available from Voith Fabrics having an office at 2100 North Ballard Road, Appleton, Wis., USA.

Figure 2:
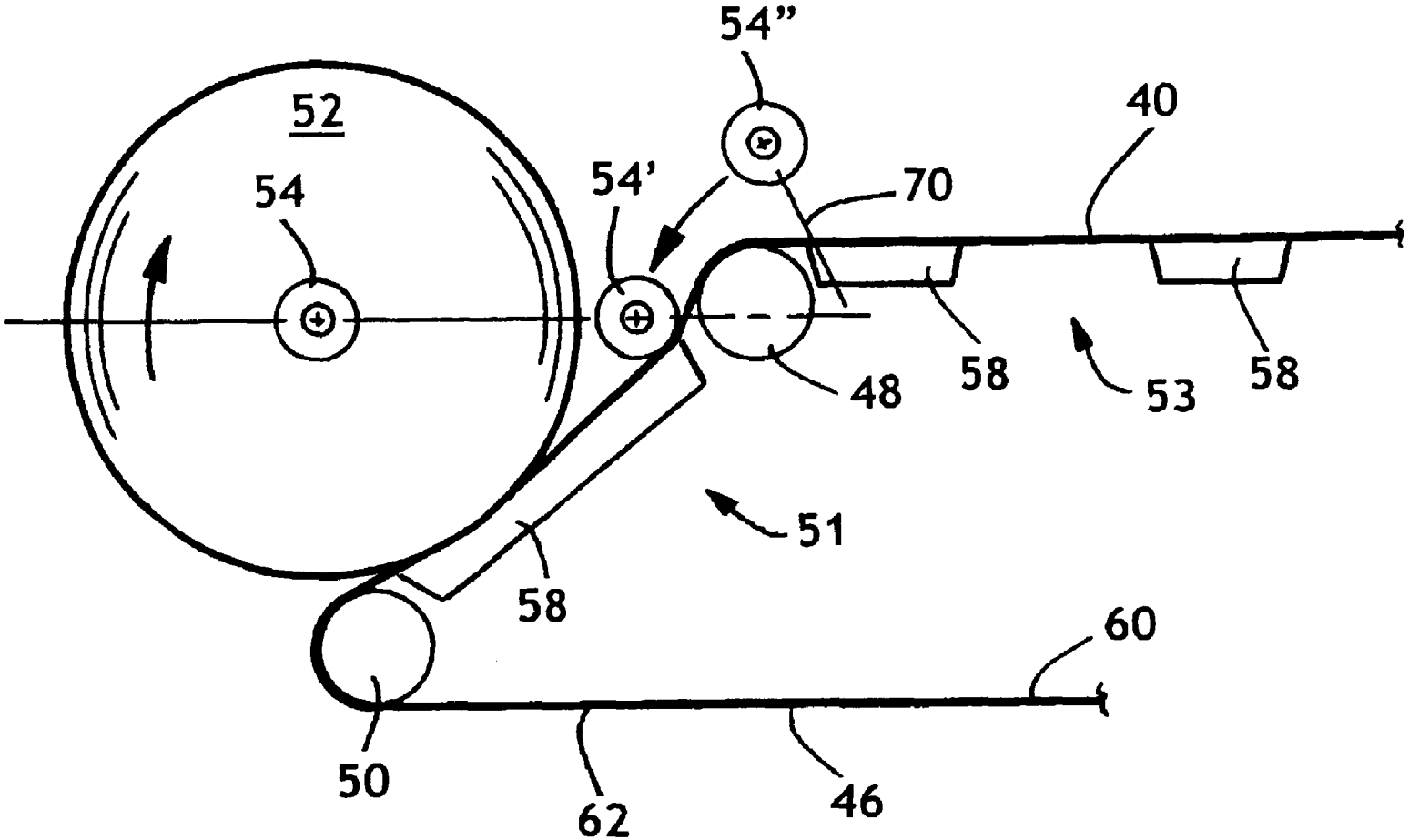
FIG. 2 illustrates a schematic diagram of the winding section of the method illustrated in FIG. 1.

The transfer belt 46 passes over two support rolls 48 and 50 having a free span between them, which defines a winding region 51 that includes the support rolls (FIG. 2). The portion of the transfer belt prior to the winding region upstream of roll 48 defines a web transport region 53 where the tissue sheet 40 is conveyed by the transfer belt 46 to the winding region 51. The transfer belt then returns to pick up the tissue sheet 40 again by use of one or more support or guide rolls as known to those of skill in the art. The tissue sheet is transferred to a parent roll 52 within the winding region 51. The parent roll 52 is wound on a reel spool 54, which is driven by a drive motor 56 acting on the shaft of the reel spool.

Located along at least a portion of the transfer belt's predetermined path within the winding region 51 is a means for pressure reduction 58. The pressure reduction means reduces the pressure along a portion of an inside surface 60 of transfer belt 46. Such pressure reduction means can include without limitation, a vacuum box, a vacuum roll, a spoiler bar, a coanda vacuum box, a venturi, a fan, or a vacuum pump.

Referring now to FIG. 2, the pressure reduction means 58 is shown in more detail. As illustrated, a coanda vacuum box functions as the pressure reduction means 58 and is located in the winding region 51. Additionally, several coanda vacuum boxes are located in the web transport region 53. The coanda vacuum box uses high velocity air directed along a curved surface to create a low pressure zone upstream of the curved surface. Coanda vacuum boxes are commercially available from Metso Corporation having an office at SE-651, Karlstad, Sweden. This type of pressure reduction means is desirable for this application since it is not necessary for the coanda vacuum box to touch the inside surface 60 in order to create a reduced pressure adjacent inside surface 60. The coanda vacuum box can be located within one inch of the transfer belt and still have the desired functionality. However, other pressure reduction means such as a conventional vacuum box with seals to the moving transfer belt could be used.

Desirably, the pressure reduction means 58 spans a substantial portion of the winding region 51 as illustrated. This is desirable since the winding tangent point of the parent roll 52 traverses the winding region as the roll's diameter increases. However, it is possible for the pressure reduction means 58 to be located along only a portion of the winding zone 51 such as directly beneath the turn-up location 54'.

The pressure reduction means 58 reduces the pressure along inside surface 60 of the transfer belt 46. This in turn tends to create a reduced pressure on an outside surface 62 of the transfer belt 46 since the transfer belt is air permeable. As such, tissue sheet 40 is pulled or drawn into contact with the outside surface 62 of transfer belt 46. Depending on the amount of pressure differential created, it is possible to even drawn air through the tissue sheet 40 and transfer belt 46. Ordinarily, the pressure reduction means is operated at a low level, such as 0–2 inches of water, to prevent undo deflection of the transfer belt as a result of the pressure differential. A large pressure differential could destabilize the control system, which responds to belt deflection to control the position of the parent roll 52 as will be discussed in more detail later.

The pressure reduction means 58 in the winding region 51 functions to improve turn-up efficiency and to control sheet wandering within the winding region. By reducing the pressure along the inside surface 60, and through means of the permeable belt along the outside surface 62, the tissue sheet 40 is drawn and held in contact with the outside surface. As a turn-up progresses, the portion of the tissue sheet 40 between support roll 48 and parent roll 52 can be destabilized by the forces acting on the sheet during a turn-up. For instance, the spinning reel spool 54 can create enough windage to pull a portion of the tissue sheet away from the transfer belt 46 prior to contacting transfer belt 46. If the winding of the reel spool 54 is not started uniformly, the tissue often will tear and break the sheet before the turn-up is completed. The pressure reduction means 58 ensures the tissue sheet remains in contact with the transfer belt 46 until the reel spool 54 is in the proper location to initiate the turn-up and maintains the tissue sheet in contact with the transfer belt until the turn-up is completed.

Secondly, often times a turn-up will create loose or torn bits of the tissue sheet 40 as the sheet is ripped to start winding on reel spool 54. These smaller portions can be drawn into the winding on the new reel spool and tear the sheet resulting in a turn-up failure. The pressure reduction means 58 controls these loose/torn tissue web portions by conveying them away from the turn-up region on the outside surface 62 of the transfer belt. As a result, the turn-up efficiency is improved.

In addition to locating the pressure reduction means 58 within the winding region 51, it is also possible to locate one or more pressure reduction means within the web transport region 53. Desirably, the pressure reduction means 58 are the coanda vacuum boxes previously described. Alternatively, other pressure reduction means can be used such as a conventional vacuum box. Desirably, the pressure reduction means 58 are located in an area when additional sheet stability is required. Such areas can include the area preceding support roll 48 or the area where dry end fabric 42 and the transfer belt 46 separate in order to ensure positive transfer of the tissue sheet 40 to the transfer belt. The pressure reduction means 58 in the web transport region 53 helps to stabilize the tissue sheet 40 reducing skating and weaving improving tissue machine runnability and the parent roll's uniformity. Generally, the coanda vacuum boxes in the web transport 53 region will operate at a vacuum level approximately equal to that of the coanda vacuum boxes in the winding region 51.

The transfer and winding of the sheet is illustrated in more detail in FIG. 2. In the winding region 51, the sheet 40 contacts and transfers to the parent roll 52. Reference numbers 54, 54' and 54" illustrate three positions of the reel spool during continuous operation. As shown, a new reel spool 54" is ready to advance to position 54' as the parent roll 52 is building. When the parent roll has reached its final predetermined diameter, the new reel spool is lowered by arm 70 into position 54' and against the incoming sheet at some point along the winding region 51 between the support rolls 48, 50. Desirably, the contact point is close to the first support roll 48 without touching the support roll so as to avoid a hard nip between the support roll and the reel spool.

At the appropriate time, one or more air jets 71 (FIG. 3) serve to blow the sheet 40 back toward the new reel spool 54' to aid in attaching the sheet to the new reel spool. Specifically, two side air jets can be located to blow towards the ends of the reel spool 54' and one or more air jets can be located adjacent to both edges of the sheet 40 blowing towards the cylindrical surface of the reel spool 54'. The reel spool 54 can comprise a conventional vacuum reel spool with apertures such that vacuum suction from within the reel spool helps to hold the web and initiate the winding process. As the sheet is transferred to the new reel spool, the sheet is broken and the parent roll 25 is kicked out to continue the winding process with a new reel spool. As previously discussed, the pressure reduction means 58 within the winding zone 51 controls the sheet during the turn-up improving turn-up efficiency.

Figure 3:
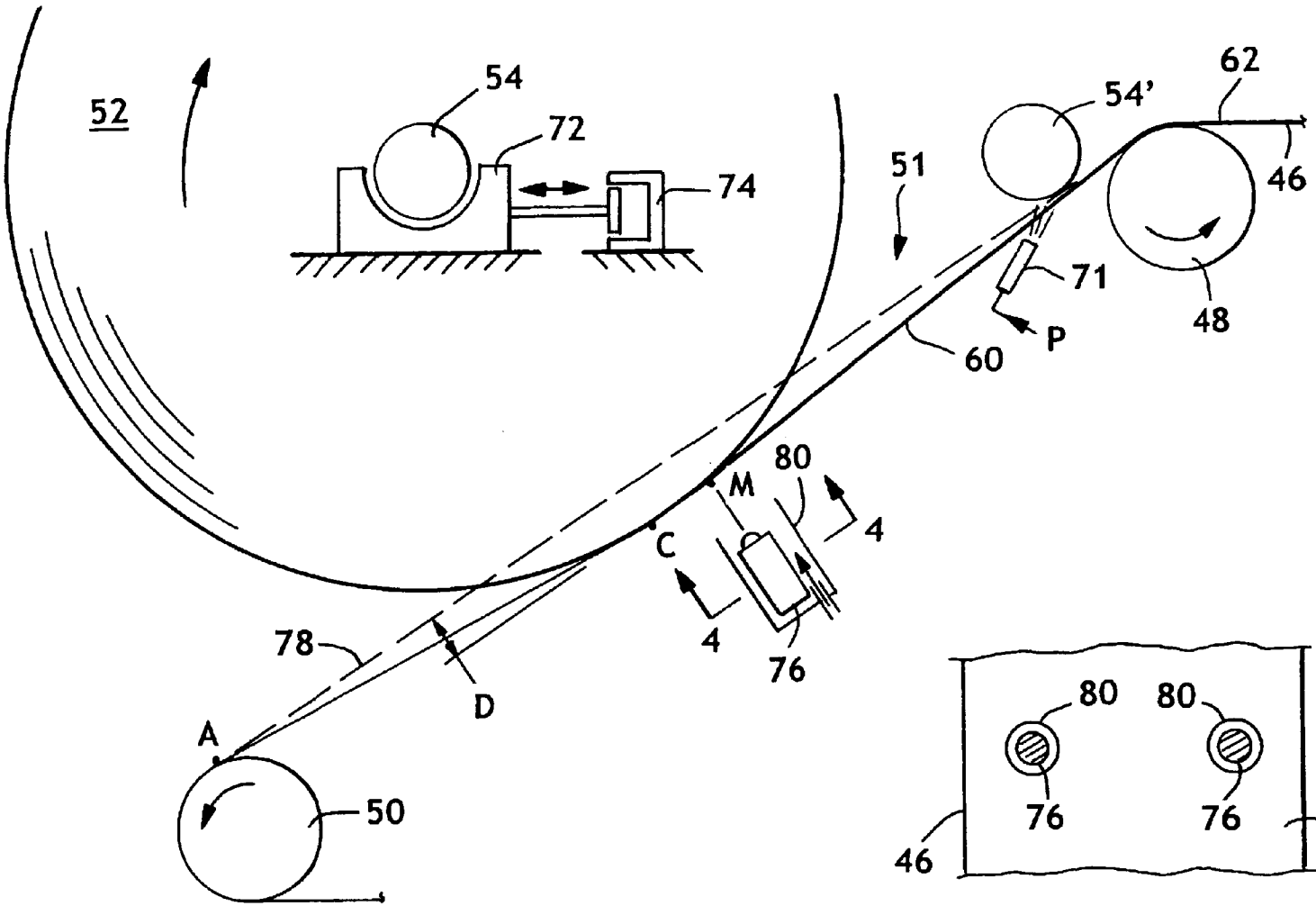
FIG. 3 illustrates an enlarged schematic diagram of the winding section, illustrating the operation of a displacement sensor in controlling the transfer belt displacement.

Referring now to FIG. 3, more details of the reel are illustrated. The previously discussed pressure reduction means 58 illustrated in FIG. 2 are removed for clarity. The reel spool 54 is supported appropriately by a pair of carriages 72, one of which is illustrated in FIG. 3. As the parent roll 52 builds, the reel spool moves toward the other support roll 50 while at the same time moving away from the transfer belt 46. The reel spool 54 can be moved in either direction by a hydraulic cylinder 74 as illustrated by the double-ended arrow to maintain the proper transfer belt deflection needed to minimize the variability of the sheet properties during the winding process. As a result, the parent roll nip substantially traverses the winding region 51 as the roll builds to its predetermined size.

Control of the relative positions of the reel spool 54 and the transfer belt 46 is suitably attained using a non-contacting sensing device 76 which is focused on surface 60 of the transfer belt 46, preferably at a point M midway between the two support rolls (48, 50) as illustrated in FIG. 3. One object is to control the pressure exerted by the parent roll 52 against the tissue sheet supported by the transfer belt 46 as well as controlling the nip length created by the contact. The sensing device 76, such as a laser displacement sensor discussed below, detects changes in transfer belt deflection of as small as 0.005 inches. A predetermined baseline value from which the absolute amount of deflection D can be ascertained is the undeflected travel path of the transfer belt 46 illustrated by a dashed line 78.

A particularly suitable laser sensing device 76 is laser displacement sensor Model LAS-8010, manufactured by Nippon Automation Company, Ltd. and distributed by Adsens Tech Inc. Other suitable contacting and non-contacting displacement sensing devices known to those of skill in the art can be used as well. The Nippon Automation LAS 8010 sensor has a focused range of 140 to 60 mm and is connected to a programmable logic controller. The front plate of the sensor can be mounted 120 mm from the inside surface of the transfer belt. Such a sensor is designed to give a 4 to 20 mA output in relation to the minimum to maximum distance between the sensor and the transfer belt. The winder is first operated without a parent roll 52 loaded against the transfer belt 46 to set the zero point in the programmable logic controller based on the undeflected path of travel 78 of the transfer belt.

The laser sensor 76 is preferably mounted within an air purge tube 80 which maintains an air flow around the laser to prevent dust from settling on the lens of the laser and interfering with the operation of the device. The laser and air tube can be incorporated into a single longer coanda vacuum box mounted adjacent the transfer belt 46 in the winding region 51, or two shorter coanda vacuum boxes can be located on either side of the laser's position.

Once the transfer belt deflection D has been measured, a proportional only control loop associated with the programmable logic controller preferably maintains that deflection at a constant level. In particular, the output of this control is the setpoint for a hydraulic servo positioning control system for the carriages 72, which hold the reel spool 54 and building parent roll. Other mechanical and electrical actuators for positioning the reel spool 54 in response to the sensor 76 in order to maintain a constant deflection D can be designed and constructed by those skilled in the art of building winders. When the transfer belt deflection D exceeds the setpoint, the carriage position setpoint is increased, thereby moving the carriages 76 away from the transfer belt returning the deflection to the setpoint.

Control of the web properties of the web unwound from the parent roll 52 can be aided by imparting a predetermined amount of web tension to the incoming web during winding, such as by programming the level of speed difference between the transfer belt 46 and the outer surface of the building parent roll 52. In most instances, a positive draw (the percentage by which the speed of the surface of the parent roll exceeds the speed of the transfer belt) is required at the parent roll in order to impart the web tension needed to provide a stable parent roll. On the other hand, too much positive draw will unacceptably reduce the machine direction stretch in the web. Therefore, the amount of positive draw will depend upon the web properties coming into the parent roll and the desired properties of the web to be unwound from the parent roll. Generally, the speed of the surface of the parent roll will be about 10 percent or less faster than the speed of the transfer belt, more specifically from about 0.5 to about 8 percent faster, and still more specifically from about 1 to about 6 percent faster. Of course, if the web approaching the parent roll already has sufficient tension provided by other means earlier in the tissue making process, a negative or zero draw may be desirable.

Figure 4:
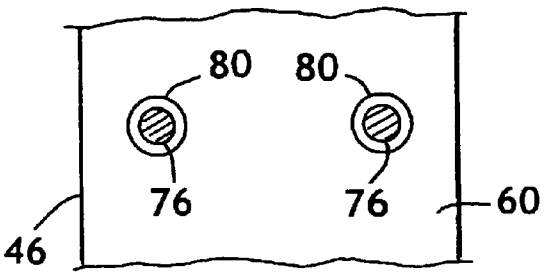
FIG. 4 illustrates a partial sectional view taken through line 4—4 of FIG. 3.

The transfer belt deflection control may use two laser distance sensors 76 sensing the surface 60, and located adjacent a respective edge of the transfer belt 46 so as to be spaced from each other in the cross machine direction as can be seen in FIG. 4. As such, undesirable tapering of the roll 52 can be minimized or a positive taper can even be introduced intentionally to improve the winding parameters of the particular roll being wound.

A specific hydraulic servo positioning system consists of Moog servo valves controlled by an Allen-Bradley QB module with Temposonic transducers mounted on the rods of the hydraulic cylinders 74 to determine position. The output from the deflection control loop is the input to two individual servo positioning systems on either side of the reel. Each system can then control, keeping the two sides of the reel parallel if desired. A protection system that stops the operation if the parallelism exceeds a certain threshold level may be desirable, but it is not necessary to have an active system to keep the two sides parallel.

The extent to which the transfer belt 46 is deflected is suitably maintained at a level of about 20 millimeters or less, more specifically about 10 millimeters or less, still more specifically about 5 millimeters or less, and still more specifically from about 1 to about 10 millimeters. In particular, the control system preferably maintains the actual transfer belt deflection at the nip at a level of about 4 mm±2 mm. Maintaining the transfer belt deflection within this range has been found to allow the parent roll 52 and the transfer belt 46 to operate with a relative speed differential but without significant power transfer. This will allow control of the winding process to maintain substantially constant sheet properties throughout the parent roll 52.

Deflection is measured perpendicular to the undeflected path of travel 78 of the transfer belt 46. It would be appreciated that the acceptable amount of deflection for any given tissue sheet is in part determined by the design of the transfer belt 46 and the tension imparted to the transfer belt during operation. As the tension is reduced, the acceptable amount of deflection will increase because the compression of the sheet is reduced and the amount of power transferred to the parent roll 52 is further reduced. In turn, the variability in the properties of the wound sheet is reduced. In addition, it may not always be desirable to maintain the amount of transfer belt deflection D at a substantially constant level and it is within the scope of the invention that the amount of deflection may be controllably varied as the roll 52 increases in diameter.

The sensed deflection D of the transfer belt 46 in combination with the sensed position of the reel spool carriages 72 may also be used to calculate the diameter of the building parent roll 52. The value calculated for the diameter of the roll can be useful in varying other operating parameters of the winding process including the rotational velocity at which the reel spool 54 is rotated by the drive motor 56 to maintain the same draw or speed relationship between the outer surface of the parent roll 52 and transfer belt 46 as the diameter of the parent roll increases.

The laser sensor 76 can be positioned to always measure the deflection of the transfer belt 46 at the midpoint the winding region 51 freespan, regardless of the parent roll position, and the actual deflection can be calculated as described below. Alternatively, the laser sensor 76 can traverse the free span with the parent roll nip such that the laser always measures the deflection directly. A further alternative is to mount the laser sensor 76 for rotation so that the laser light source can be rotated to maintain a desired aim on the transfer belt 46.

In the situation where the laser position is fixed at the midpoint of the free span and the deflection is measured by the laser 76 at that point, the actual deflection at the parent roll nip point is calculated according to the position of the building parent roll 52, which traverses from one end of the open span to the other on the carriages 72 while it builds. Since the laser 76 is mounted in the middle of the free span of the transfer belt 46 between the two support rolls (48, 50) and only measures the deflection of the transfer belt at that position, the actual deflection at the nip is closely approximated by the measured deflection in the middle of the free span times the following ratio: the distance from the laser measurement point M to the nip point A of the support roll nearest the nip point C of the parent roll (support roll 50 in FIG. 3) divided by the distance from the nip point of the parent roll C to the nip point of that same support roll A. For purposes of this calculation, the nip points of the support rolls are the tangent points at which the undeflected path of travel 78 of the transfer belt in the free span contacts the support rolls. The nip point C of the parent roll is the midpoint of the wrap of the transfer belt 46 around the periphery of the parent roll 25.

This is illustrated in FIG. 3, where the actual deflection D is the measured deflection at point M (the midpoint of the free span) times the ratio of the distance MA to the distance CA. If the parent roll 52 was precisely in the middle of the free span, the ratio would be 1 and the laser would be measuring the actual deflection D. However, when the parent roll 52 is positioned on either side of the midpoint of the free span, the deflection of the transfer belt measured by the laser at the midpoint is always less than the actual deflection at the transfer point.

The length of the unsupported winding zone 51 between the support rolls 48, 50 needs to be long enough to allow the new reel spool 54' to be placed between the first or upstream support roll 48 and the full-sized parent roll. On the other hand, the free span needs to be short enough to prevent sagging of the fabric so that the amount of tension can be minimized and the degree of deflection can be controlled. A suitable winding zone length can be from about 1 to about 5 meters, and more specifically from about 2 to about 3 meters.

The advantages of the apparatus and method according to the present invention allow the production of parent rolls of tissue having highly desirable properties. In particular, parent rolls of high bulk tissue can be manufactured having a diameter of about 70 inches or greater, wherein the bulk of the tissue taken from the roll is about 9 cubic centimeters per gram or greater, the coefficient of variation of the finished basis weight is about 2% or less and the coefficient of variation of the machine direction stretch is about 6% or less. In addition, the coefficient of variation of the sheet bulk for tissue sheets taken from the parent roll can be about 3.0 or less.

More specifically, the diameter of the parent roll can be from about 100 to about 150 inches or greater. The coefficient of variation of the finished basis weight can be about 1% or less. The coefficient of variation of the machine direction stretch can be about 4% or less, still more specifically about 3% or less. The coefficient of variation of the sheet bulk can be about 2.0 or less.

As used herein, high bulk tissues are tissues having a bulk of 9 cubic centimeters or greater per gram before calendering. Such tissues are described in U.S. Pat. No. 5,607,551 issued Mar. 4, 1997 to Farrington, Jr. et al. entitled "Soft Tissue", which is herein incorporated by reference. More particularly, high bulk tissues for purposes herein can be characterized by bulk values of from 10 to about 35 cubic centimeters per gram, more specifically from about 15 to about 25 cubic centimeters per gram. The method for measuring bulk is described in the Farrington, Jr. et al. patent.

In addition, the softness of the high bulk tissues of this invention can be characterized by a relatively low stiffness as determined by the MD Max Slope and/or the MD Stiffness Factor, the measurement of which is also described in the Farrington, Jr. et al. patent. More specifically, the MD Max Slope, expressed as kilograms per 3 inches of sample, can be about 10 or less, more specifically about 5 or less, and still more specifically from about 3 to about 6. The MD Stiffness Factor, expressed as (kilograms per 3 inches)-microns$^{0.5}$, can be about 150 or less, more specifically about 100 or less, and still more specifically from about 50 to about 100.

Furthermore, the high bulk tissues of this invention can have a machine direction stretch of about 10 percent or greater, more specifically from about 10 to about 30 percent, and still more specifically from about 15 to about 25 percent. In addition, the high bulk tissues of this invention suitably can have a substantially uniform density since they are preferably through-air dried to final dryness without any significant differential compression.

An advantage of the method of this invention is the resulting improved uniformity in the sheet properties unwound from the parent roll. Very large parent rolls can be wound while still providing substantial sheet uniformity due to the control of the winding pressure on the sheet. Another advantage of the method of this invention is that soft, high bulk tissue sheets can be wound into parent rolls at high speeds. Suitable machine speeds can be from about 3000 to about 6000 feet per minute or greater, more specifically from about 4000 to about 6000 feet per minute or greater, and still more specifically from about 4500 to about 6000 feet per minute.

Many modifications and other embodiments of the invention will come to mind to one skilled in the art to which this invention pertains having the benefit of the teachings presented in the foregoing descriptions and the associated drawings. For example, the apparatus and method according to the present invention are not limited to use with only tissue, but may also be highly advantageous in winding all types of web materials, including other forms of paper such as paperboard. Therefore, it is to be understood that the invention is not to be limited to the specific embodiments disclosed and that modifications and other embodiments are intended to be included within the scope of the appended claims. In addition, although specific terms are employed herein, they are used in a generic and descriptive sense only and not for purposes of limitation.

We claim:

1. An apparatus for winding a web into a roll comprising:

a rotatably mounted reel spool;

an air permeable endless flexible member mounted for rotation along a predetermined path of travel having a winding region and a web transport region, and the winding region is positioned adjacent to the reel spool;

a sensor measuring a deflection of the flexible member from the predetermined path of travel;

an actuator for positioning the reel spool and the flexible member relative to each other to vary the deflection of the flexible member;

a controller connected to the sensor and the actuator for controlling the deflection of the flexible member as the roll increases in diameter; and a means for pressure reduction located along at least a portion of the predetermined path of travel in the winding region.

2. The apparatus of claim 1 wherein the pressure reduction means comprises a coanda vacuum box.

3. The apparatus of claim 1 wherein the pressure reduction means comprises a vacuum box.

4. The apparatus of claim 1 further comprising a means for pressure reduction located along at least a portion of the web transport region.

5. The apparatus of claim 4 wherein the pressure reduction means comprises a coanda vacuum box.

6. The apparatus of claim 1 wherein the endless flexible member has an air permeability greater than about 50 cfm/ft$^2$.

7. The apparatus of claim 1 wherein the reel spool contains a plurality of apertures operatively connected to a vacuum source.

8. The apparatus of claim 1 further comprising a drive motor operably connected to the reel spool for rotating the reel spool.

9. The apparatus of claim 1 further comprising at least one air jet directed towards the reel spool during a turn-up.

10. An apparatus for winding a web of paper material into a roll comprising:

a rotatably mounted reel spool;

a drive motor for rotating the reel spool and winding a paper web thereon to create a parent roll of increasing diameter;

an air permeable endless flexible belt having an inside surface and an outside surface supported for rotation around a plurality of support rolls defining a predetermined path of travel, the predetermined path of travel having a winding region including a free span and a pair of support rolls, and a web transport region preceding the winding region, the paper web residing on the outside surface and positioned adjacent the reel spool engaging the reel spool during winding such that the free span is deflected from the predetermined path of travel by the paper web wound on the reel spool;

a deflection sensor mounted within the belt measuring a deflection of the inside surface from the predetermined path of travel;

an actuator for positioning the reel spool and the belt relative to each other to vary the deflection of the inside surface;

a controller connected to the deflection sensor and the actuator for controlling the deflection of the inside surface as the parent roll diameter increases; and a means for pressure reduction located along at least a portion of the inside surface in the winding region.

11. The apparatus of claim 10 wherein the pressure reduction means comprises a coanda vacuum box.

12. The apparatus of claim 10 wherein at least one of the support rolls in the winding region is a vacuum roll and the vacuum roll comprises the pressure reduction means.

13. The apparatus of claim 10 further comprising a means for pressure reduction located along at least a portion of the web transport region.

14. The apparatus of claim 13 wherein the pressure reduction means comprises a coanda vacuum box.

15. The apparatus of claim 10 wherein the endless flexible member has an air permeability greater than about 50 $cfm/ft^2$.

16. The apparatus of claim 10 wherein the reel spool contains a plurality of apertures operably connected to a source of vacuum.

17. The apparatus of claim 10 wherein the pressure reduction means comprises substantially the entire portion of the winding region.

18. The apparatus of claim 10 wherein at least one air jet is directed at the reel spool during a turn-up.

19. A method of winding a web to form a roll comprising the steps of:

engaging an air permeable endless flexible member against a reel spool creating a nip such that the flexible member is deflected from a predetermined path of travel, the endless flexible member having a winding region, a web transport region, and an inside surface;

rotating the reel spool;

rotating the endless flexible member;

advancing the web into the nip and directing the web around the reel spool to form a roll of increasing diameter;

sensing the amount of deflection of the flexible member by the roll as the diameter of the roll increases;

moving at least one of the reel spool and the flexible member in response to the sensing step to vary the amount of deflection of the flexible member; and reducing the pressure along at least a portion of the inside surface within the winding region.

20. The method of claim 19 further comprising the step of reducing the pressure along at least a portion of the inside surface within the web transport region.

21. The method of claim 19 further comprising the step of directing an air jet at the reel spool during a turn-up.

* * * * *